US006457290B1

(12) United States Patent
Elliott

(10) Patent No.: US 6,457,290 B1
(45) Date of Patent: Oct. 1, 2002

(54) SHINGLE WITH A RENDERED SHADOW DESIGN

(75) Inventor: Bert Whitmore Elliott, Westerville, OH (US)

(73) Assignee: Owens Corning Fiberglas Technology, Inc., Summit, IL (US)

( * ) Notice: Subject to any disclaimer, the term of this patent is extended or adjusted under 35 U.S.C. 154(b) by 0 days.

(21) Appl. No.: 09/516,441

(22) Filed: Feb. 29, 2000

(51) Int. Cl.[7] ..... E04D 1/26; E04D 1/28

(52) U.S. Cl. ..... 52/557; 52/554; 52/555; 52/559; 52/314; 52/315; 427/188

(58) Field of Search ..... 52/554, 555, 557, 52/558, 559, 314, 315, 316, DIG. 16; 427/188, 187, 186; D25/139

(56) References Cited

U.S. PATENT DOCUMENTS

| | | | | | |
|---|---|---|---|---|---|
| 1,601,731 | A | * | 10/1926 | Flood | 52/555 |
| 3,613,328 | A | | 10/1971 | Morgan, Jr. et al. | |
| 3,624,975 | A | | 12/1971 | Morgan et al. | |
| 3,921,358 | A | * | 11/1975 | Bettoli | 52/557 X |
| 4,274,243 | A | * | 6/1981 | Corbin et al. | 52/557 X |
| 4,717,614 | A | * | 1/1988 | Bondoc et al. | 52/557 X |
| D313,278 | S | | 12/1990 | Noone | |
| D326,330 | S | | 5/1992 | Klein | |
| 5,195,290 | A | | 3/1993 | Hulett | |
| D336,347 | S | | 6/1993 | Hannah et al. | |
| D340,294 | S | | 10/1993 | Hannah et al. | |
| D343,911 | S | | 2/1994 | Hulett | |
| D344,144 | S | | 2/1994 | Weaver et al. | |
| 5,347,785 | A | | 9/1994 | Terrenzio et al. | |
| 5,369,929 | A | | 12/1994 | Weaver et al. | |
| 5,426,902 | A | | 6/1995 | Stahl et al. | |
| 5,488,807 | A | | 2/1996 | Terrenzio et al. | |
| D369,421 | S | | 4/1996 | Kiik et al. | |
| D376,660 | S | | 12/1996 | Hannah et al. | |
| 5,660,014 | A | | 8/1997 | Stahl et al. | |
| 5,664,385 | A | | 9/1997 | Koschitzky | |
| 5,666,776 | A | | 9/1997 | Weaver et al. | |
| D388,195 | S | | 12/1997 | Hannah et al. | |
| 5,901,517 | A | | 5/1999 | Stahl et al. | |
| 6,014,847 | A | * | 1/2000 | Phillips | 52/555 X |
| 6,038,827 | A | * | 3/2000 | Sieling | 52/557 |
| 6,105,329 | A | * | 8/2000 | Bondoc et al. | 52/555 X |
| 6,190,754 | B1 | * | 2/2001 | Bondoc et al. | 52/555 X |

* cited by examiner

*Primary Examiner*—Laura A. Callo
(74) *Attorney, Agent, or Firm*—Inger H. Eckert; James J. Dottavio

(57) ABSTRACT

A laminated shingle has a rendered shadow design when placed with other similar shingles on a roof deck. The laminated shingle includes an overlay member and an underlay member fixedly attached to each other. The overlay member includes an upper or headlap portion and a lower or exposed butt portion with one or more tabs separated by cutouts. The underlay member is coated with a layer of relatively dark granules to form vertically and horizontally-oriented shading areas. In one embodiment, one or both vertical edges of each tab are generally parallel to the vertically-oriented longitudinal axis of the vertically-oriented shading area to expose a portion of the shading area. In another embodiment, the width of each tab is randomly selected and the width of the vertically-oriented shading area is a function of the width of the adjacent tab. In yet another embodiment, the intensity of the shading areas can increase from the bottom to the top of each cutout. The overlay member can also include a layer of relatively dark granules randomly applied to the upper and lower edges of the tabs. In still yet another embodiment, the tabs and cutouts of the overlay member have non-parallel vertical edges. A laminated shingle with a rendered shadow design can be formed using any combination of the above-disclosed embodiments.

20 Claims, 7 Drawing Sheets

SHINGLE WITH A RENDERED SHADOW DESIGN

TECHNICAL FIELD

This invention relates in general to a shingle, and in particular, to a laminated roofing shingle including an overlay with cutouts and tabs and an underlay with shadow lines such that the shingle provides a three-dimensional effect with richness and depth.

BACKGROUND OF THE INVENTION

In the past, roofing shingles have had to satisfy two main functions when applied to a roof deck. The first function is to provide a durable, weatherproof covering for the roof deck. Roof shingles, whatever their form, are intended to provide a means of sheltering the structure below the shingles from precipitation and the deleterious effects of sun and wind. Roof shingles installed on the roof deck must perform these protecting functions for a reasonable period of time. The second function is to present an aesthetically pleasing architectural feature which enhances the overall appeal of the structure to which the shingles have been applied. This aesthetic function has been satisfied by providing asphalt shingles with various butt edge contours and surface treatments which operate to simulate more traditional, and in most cases more expensive, forms of roof coverings, such as thatch, wooden shakes, slates, and even tiles of various forms.

Although several attempts have been made to design a laminated shingle with a shadow look, there is a need to produce a shingle on a production scale with a high style shadow look of the laminated shingle.

SUMMARY OF THE INVENTION

This invention relates to a laminated shingle. In one embodiment, the laminated shingle comprises an overlay member and an underlay member. The overlay member has a front surface, a rear surface, an upper portion and a lower portion. The lower portion includes one or more tabs separated by cutouts. Each cutout includes a pair of spaced apart vertical edges extending from a lower boundary of the upper portion of the overlay member to a lower edge of the lower portion of the overlay member. Each cutout also includes an upper edge extending between the pair of vertical edges.

The underlay member has a front surface attached to the rear surface of the overlay member. The underlay member includes a layer of granules on the front surface to form at least one vertically-oriented, generally elongated shading area having a vertically oriented longitudinal axis being substantially parallel to a vertical axis of the underlay member. The vertically-oriented shading area is darker in appearance than a remainder of the underlay member. The vertically-oriented longitudinal axis of the at least one vertically-oriented shading area of the underlay member is generally collinear with at least one of the pair of edges of at least one cutout of the overlay member, thereby exposing, within a cutout, a portion of the vertically-oriented shading area of the underlay member.

According to this invention, there is also provided a laminated shingle including an overlay member having a front surface, a rear surface, an upper portion and a lower portion, the lower portion including one or more tabs separated by cutouts, each cutout including a pair of spaced apart vertical edges extending from a lower boundary of the upper portion of the overlay member to a lower edge of the lower portion of the overlay member. Each cutout also includes an upper edge extending between the pair of vertical edges. The laminated shingle also includes an underlay member having a front surface attached to the rear surface of the overlay member. The underlay member includes a layer of granules on the front surface to form at least one shading area having two substantially vertical edges, being substantially parallel to a vertical axis of the underlay member. The shading area is darker in appearance than a remainder of the underlay member. One of the cutout vertical edges is arranged so that it is positioned between the vertical edges of the shading area of the underlay member, thereby exposing a portion of the vertically-oriented shading area of the underlay member.

According to this invention, there is also provided a laminated shingle that includes an overlay member having a front surface, a rear surface, an upper portion and a lower portion, the lower portion including one or more tabs separated by cutouts, each tab having a centerline substantially parallel to a vertical axis of the overlay member, at least one cutout including a pair of vertical edges extending from a lower boundary of the upper portion of the overlay member to a lower edge of the overlay member and an upper edge extending between the pair of vertical edges. The shingle also includes an underlay member having a front surface attached to the rear surface of the overlay member, the underlay member including a layer of granules on the front surface to form vertically-oriented, generally elongated shading areas having vertically-oriented longitudinal axes being substantially parallel to a vertical axis of the underlay member. The centerline of each tab of the overlay member substantially aligns with a vertically-oriented longitudinal axis of the shading areas of the underlay member to expose a portion of each of the shading areas of the underlay member.

According to this invention, there is also provided a laminated shingle that includes an overlay member having a front surface, a rear surface, an upper portion and a lower portion, the lower portion including one or more tabs separated by cutouts, each cutout including a pair of non-parallel edges extending from a lower boundary of the upper portion of the overlay member to a lower edge of the lower portion of the overlay member, each cutout also including an upper edge extending between the pair of vertical edges. The shingle also includes an underlay member having a front surface attached to the rear surface of the overlay member, the underlay member including a layer of granules on the front surface to form a vertically-oriented shading area having a pair of non-parallel edges being generally parallel to one of the pair of non-parallel edges of at least one cutout of the underlay member. At least one non-parallel edge of the vertically-oriented shading area of the underlay member substantially aligns with at least one non-parallel edge of at least one cutout of the overlay member, thereby exposing a portion of the vertically-oriented shading area of the underlay member.

According to this invention, there is also provided a laminated shingle that includes an overlay member having a front surface, a rear surface, an upper portion and a lower portion, the lower portion including a series of tabs separated by cutouts, each cutout including a pair of spaced apart vertical edges extending from a lower boundary of the upper portion of the overlay member to a lower edge of the lower portion of the overlay member, each cutout also including an upper edge extending between the pair of vertical edges. An underlay member has a front surface attached to the rear surface of the overlay member, the underlay member including a layer of granules on the front surface to form a series of shading areas being darker in appearance than the remainder areas of the underlay member, each of the shading areas having a shading area edge separating the darker shading area from an adjacent, lighter remainder area of the shingle. The shading area edges are arranged so that they are positioned between the vertical edges of the cutouts, thereby exposing portions of the shading areas of the underlay member.

According to this invention, there is also provided a roof covering that includes a plurality of successive generally horizontal courses of laminated shingles, the shingles in each course being laid in a side-by-side relationship and horizontally offset from the shingles in adjacent courses. Each laminated shingle includes an overlay member having a front surface, a rear surface, an upper portion and a lower portion, the lower portion including one or more tabs separated by cutouts, each cutout including a pair of spaced apart vertical edges extending from a lower boundary of the upper portion of the overlay member to a lower edge of the lower portion of the overlay member, each cutout also including an upper edge extending between the pair of vertical edges. Each shingle also includes an underlay member having a front surface attached to the rear surface of the overlay member, the underlay member including a layer of granules on the front surface to form at least one shading area having two substantially vertical edges, being substantially parallel to a vertical axis of to the underlay member, the shading area being darker in appearance than a remainder of the underlay member. One of the cutout vertical edges is arranged so that it is positioned between the vertical edges of the shading area of the underlay member, thereby exposing a portion of the vertically-oriented shading area of the underlay member.

Various objects and advantages of this invention will become apparent to those skilled in the art from the following detailed description of the preferred embodiment, when read in light of the accompanying drawings.

DETAILED DESCRIPTION AND PREFERRED EMBODIMENTS OF THE INVENTION

Figure 1:
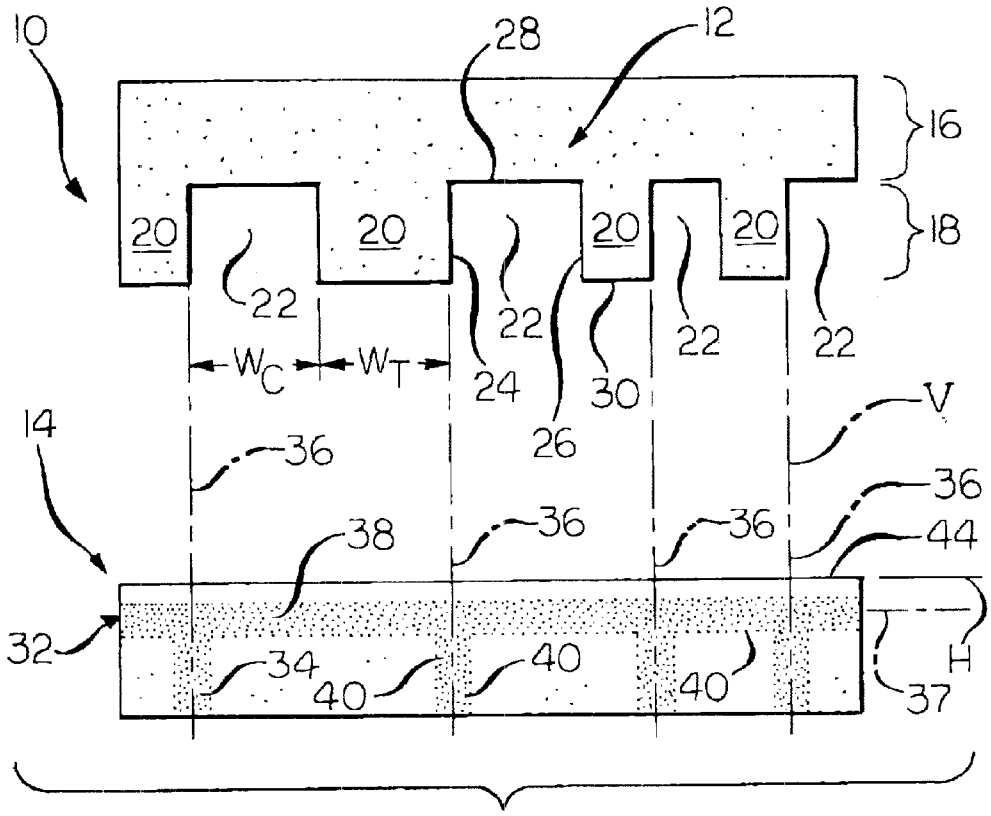
FIG. 1 is an exploded view of a shingle with a rendered shadow design according to a first embodiment of the invention.
Figure 2:
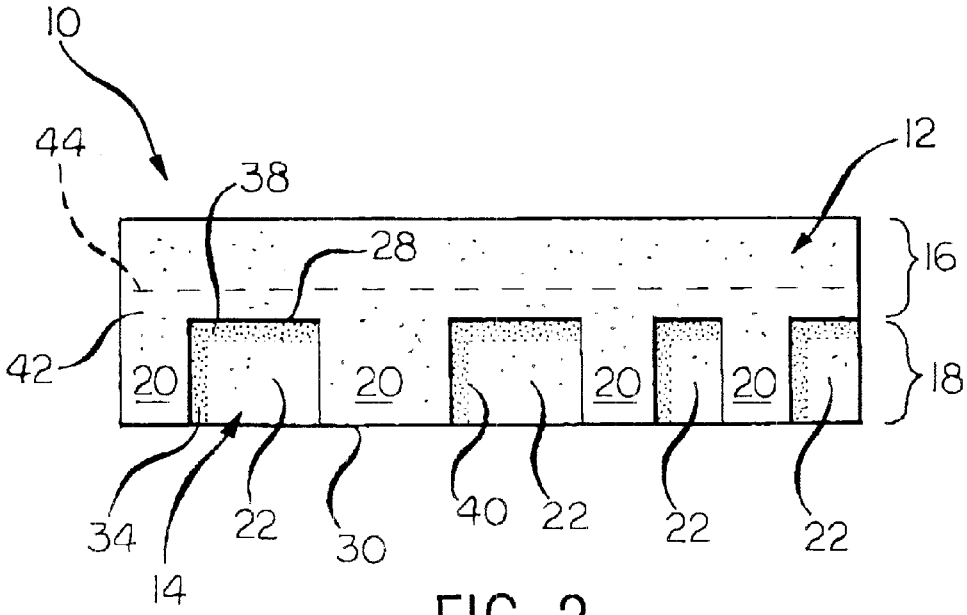
FIG. 2 is a top planar view of the completed shingle of FIG. 1.
Figure 3:
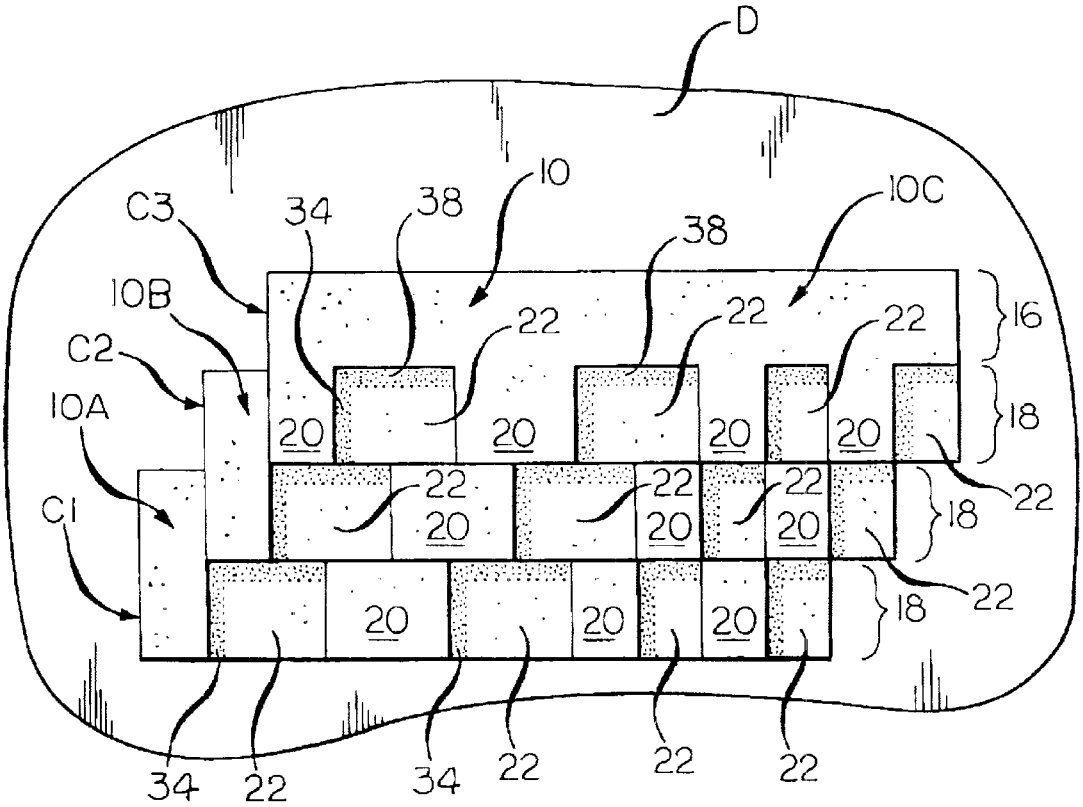
FIG. 3 is a top planar view of a portion of a roof deck covered with the shingles of FIG. 1.

Referring now to the drawings, there is illustrated in FIGS. 1–3 a shingle, shown generally at 10, according to a first embodiment of the invention. The shingle 10 is of a type of roofing shingle generally known as a laminated type shingle consisting of an overlay member 12 and an underlay member 14. The overlay and underlay members 12, 14 are preferably constructed of a suitable mat of fiberglass or other construction that is permeated with a preferably asphaltic substance of a type well-known in the art. Typically, a plurality of granules are dispersed over the front surface and are held by the adhesive characteristics of the asphaltic substance permeating the front surface. It should be appreciated that the invention is not limited by the material composition of the overlay and underlay members 12, 14. For example, the overlay and underlay members 12, 14 may comprise a laminar felted material comprising organic or inorganic fibers, or a mixture of both, that are held together with a binding agent. The fibers may be subsequently coated, saturated, or otherwise impregnated with an asphaltic bituminous material according to processes well known in the roofing industry.

The overlay member 12 includes a headlap or upper portion 16 and an exposed butt or lower portion 18. The lower portion 18 includes one or more tabs 20 and preferably a series of tabs, which are separated by one another by one or more cutouts 22. Each cutout 22 includes a pair of spaced apart vertical edges 24, 26 extending from a lower boundary 28 of the upper portion 16 of the overlay member 12 to a lower edge 30 of the lower portion 18 of the overlay member 12. The lower boundary 28 of the upper portion 16 of the overlay member 12 forms an upper edge of each cutout 22 extending between the pair of vertical edges 24, 26. It will be appreciated that the width $W_C$ of each cutout 22 and the width $W_T$ of each tab 20 can be selected to any desirable dimension. In the first embodiment, the vertical edges 24, 26 of each cutout 22 are generally parallel to each other.

In the first embodiment, the underlay member 14 includes a layer of granules 32 on the front surface. Preferably, the layer of granules 32 is applied to the front surface with such a preciseness as to form one or more vertically-oriented shading areas 34. Preferably, the vertically-oriented shading areas 34 are darker in appearance than the remainder of the underlay member 14, which can be covered with background granules of a lighter color. As best shown in FIG. 1, each vertically-oriented shading area 34 has a vertically-oriented longitudinal axis 36 that is substantially parallel to a vertical axis, V, of the underlay member 14. In this manner, the vertically-oriented longitudinal axis substantially is co-linear with one of the vertical edges 24, 26 forming each cutout 22 of the overlay member 14, thereby exposing a portion of the vertically-oriented shading area of the underlay member. As used herein, the term "substantially aligns" means co-linear or spaced apart, but generally parallel to each other. In the first embodiment, the shading areas 34 are exposed within the cutout only on a specific side of each tab 20, such as the right hand side, to provide a uniform shadow rendering design to the roof. However, it will be appreciated that the shading areas 34 can be exposed only on the left hand side of the tabs, or any combination thereof.

The shading areas 34 are defined by two substantially vertical edges 40 that are substantially parallel to the vertical axis V of the underlay member 14. It can be seen that one of the cutout vertical edges 24 is arranged so that it is positioned horizontally between the vertical edges 40 of the shading area 34 of the underlay member, thereby exposing a portion of the vertically-oriented shading area of the underlay member.

Also, it can be seen that each of the right hand edges 40 of the vertically-oriented shading areas are arranged so that they are positioned between the vertical edges 24, 26 of the cutouts, thereby exposing a portion of the vertically-oriented shading area of the underlay member.

In addition, it is desirable that edges 40 of the shading area 34 are generally non-linear or non-sharp to provide a more realistic shadow rendering design. In other words, the edges 40 of the shading areas 34 do not form a sharp demarcation at the junction between the shading area edges 40 and the remainder of the underlay member 14. As a result, the granules forming the shading areas 34 should be slightly blended with the granules on the remainder of the underlay member 14 to provide a more realistic appearance.

In addition, in the preferred embodiment of the invention shown in FIGS. 1–3, the layer of granules 32 also forms a horizontally-oriented shading area 38 to cause a portion of the front surface of the underlay 14 to appear dark or black in appearance in contrast to the remainder of the underlay granules. Preferably, the horizontally-oriented shading area 38 has a horizontally-oriented longitudinal axis 37 that is substantially parallel to the horizontal axis, H, of the underlay member 14. In a manner similar to the non-linear edges 40 of the shading area 34, it is desirable that the edges 40 of the shading area 38 are generally non-linear or fuzzy to provide a more realistic shadow rendering design. The horizontally-oriented shading area 38 is formed such that the lower boundary 28 of the upper portion or headlap 16 exposes a portion of the horizontally-oriented shading area 38 when the laminated shingle 10 is formed. The preciseness required to form the shading areas 34, 38 can be achieved by using a pneumatic granule blender (not shown), as described in co-assigned U.S. Pat. No. 5,746,830, herein incorporated by reference. It can be seen that the vertical and horizontal shading areas 34, 38 could be referred to as first and second shading areas, in no particular order, and that therefore the underlay 14 and overlay 12 combine to form two shading areas, a first shading area having a vertically-oriented longitudinal axis parallel to a vertical axis of the underlay member and a second shading area having a horizontally-oriented longitudinal axis substantially parallel to a horizontal axis of the underlay member.

To form the laminated shingle 10 of the invention, the rear surface of the overlay member 12 and the front surface of the underlay member 14 are fixedly attached to each other, as best shown in FIG. 2. This can be accomplished by using adhesive materials applied to the front surface of the underlay member 14 and the rear surface of the overlay member 12 in a variety of different ways. For example, an adhesive may be applied between each tab 20 of the overlay member 12 and the corresponding underlying portion of the underlay member 14. Additionally, it may be desirable to provide a common bonding area 42 defined by the area of overlap between an upper edge 44 of the underlay member 14 and the lower boundary 28 of the overlay member 12. Preferably, the common bonding area 42 extends substantially the entire width of the shingle 10 proximate to the lower boundary 28 of the overlay member 16. The height of the common bonding area 42 depends on the height of the cutouts 22 with respect to the height of the underlay member 14. In addition, the height of the common bonding area 42 depends on the height of the completed shingle 10. For the completed shingle 10 having a width of approximately 40 inches (101.6 cm) and an overall height of approximately 17.0 inches (43.2 cm), the common bonding area 42 has a width in the range of about 1 to 2 inches, and more preferably about 1.5 inches (3.8 cm). It should be appreciated that the invention is not limited by the dimensions of the shingle 10, and that the invention can be practiced with any dimensions. For example, the width of the shingle 10 may be approximately 36 inches (91.4 cm) and the height 34 may be approximately 24.0 inches (61.0 cm).

Referring now to FIG. 3, there is illustrated a fragmentary roof deck, D, with a roof covering made with a plurality of roofing shingles 10 according to the first embodiment of the invention. In general, the roofing shingles 10 are arranged in a series of horizontal courses of which a portion of three such courses C1, C2 and C3 are shown. Shingle 10A in course C1 is shown being overlapped by shingle 10B in course C2. Likewise, shingle 10B in course C2 is shown being overlapped by shingle 10C in course C3. The extreme left-most and right-most edges of shingles 10A, 10B, 10C are shown without adjoining shingles which would normally precede and succeed these shingles in each of the courses, C1, C2, C3. This is done in order to more fully illustrate the desired placement of each shingle in each overlapping course. Thus, it is understood that the roof deck, D, in the finished roof covering would be substantially completely covered by a plurality of substantially identically shaped shingles 10A, 10B, and 10C. It may be desirable to offset each overlapping course to prevent the joint which is formed between each adjacent shingle in each course from corresponding to the joint between the shingles in the subsequent overlapping course. If this were not done, water from precipitation would inevitably penetrate these joints and find its way to potentially damage the underlying roof deck, D. In offsetting these joints, there is no direct path for such water between each shingle. In addition to preventing the penetration of water from precipitation, offsetting shingles in subsequent overlapping courses provides an overall aesthetic effect.

Figure 4:
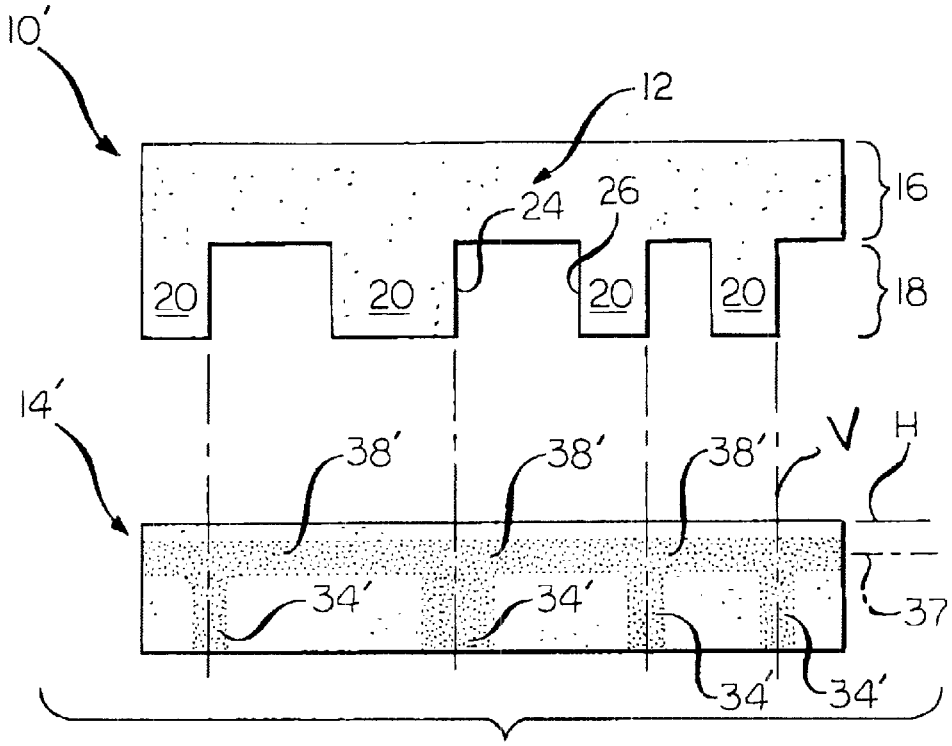
FIG. 4 is an exploded view of a shingle with a rendered shadow design according to a second embodiment of the invention.
Figure 5:
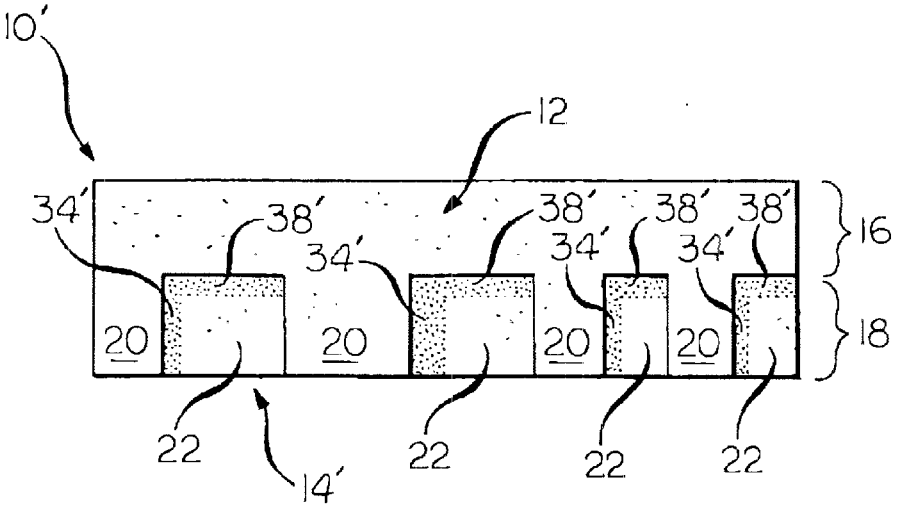
FIG. 5 is a top planar view of the completed shingle of FIG. 4.

FIGS. 4 and 5 illustrate a shingle 10' according to a second embodiment of the invention. In the second embodiment, the overlay member 12 is substantially identical to the overlay member 12 (FIG. 1) in the first embodiment. The underlay member 14' is identical to the underlay member 14 of the first embodiment, except that the widths of the shading areas 34' vary as a function of the width of the adjacent tab 20. For example, the width of the vertically-oriented shading area 34' adjacent a relatively wide tab 20 may be wider than the vertically-oriented shading area 34' adjacent a relatively narrow tab 20. In this example, the wider tab 20 provides a longer or wider shadow than the narrower tab 20 to provide a more realistic shadow rendering design. It will be appreciated that the width of the vertically-oriented shading areas 34' can be randomly selected to any desirable width to vary the length (i.e., in the direction of the width of the shingle) of the shadow for the tab 20. In a manner similar to that of the first embodiment, the vertically-oriented longitudinal axis of the vertically-oriented shading area 34' is substantially parallel to a vertical axis, V, of the underlay member 14'. As best seen in FIG. 5, the completed shingle 10' of the second embodiment has a different rendering shadow design from the shingle 10 of the first embodiment of the invention.

As also seen in FIG. 5, the width of the exposed portion (i.e., exposed through the cutouts) of the shading area 34' varies as a function of the width of the adjacent tab. It can be seen that the width of the exposed portion of the shaded area 34' showing through the second cutout from the left in FIG. 5 is wider than the exposed portion of the other shaded areas 34' showing through the first, third and fourth cutouts.

Figure 6:
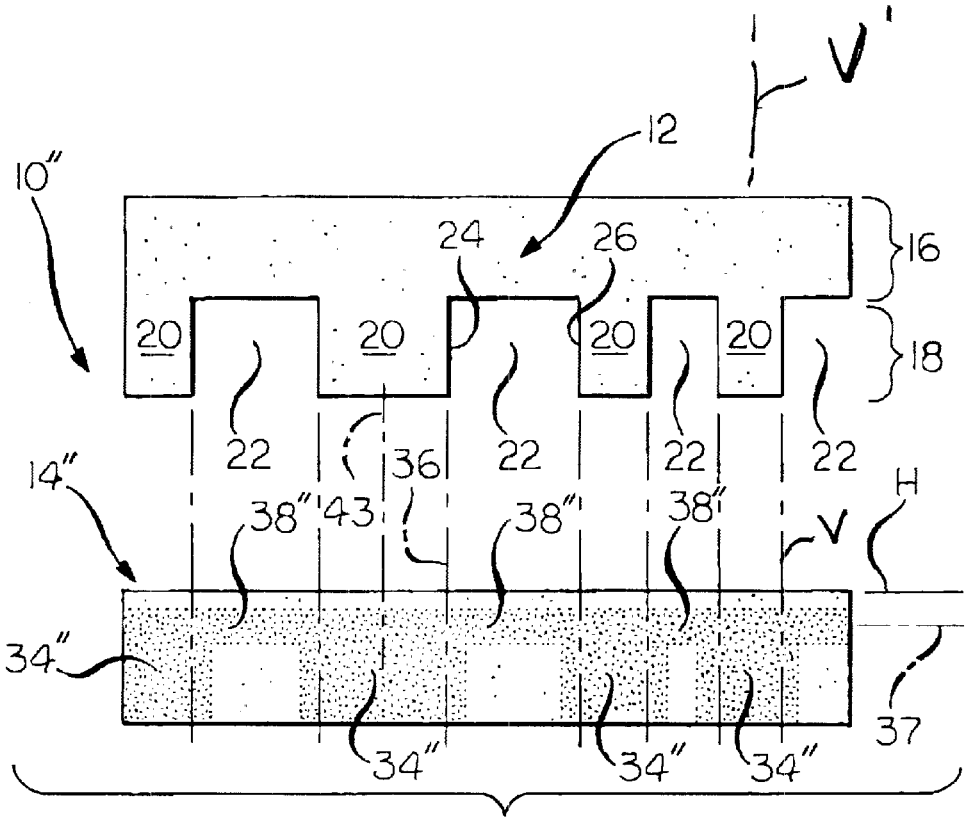
FIG. 6 is an exploded view of a shingle with a rendered shadow design according to a third embodiment of the invention.
Figure 7:
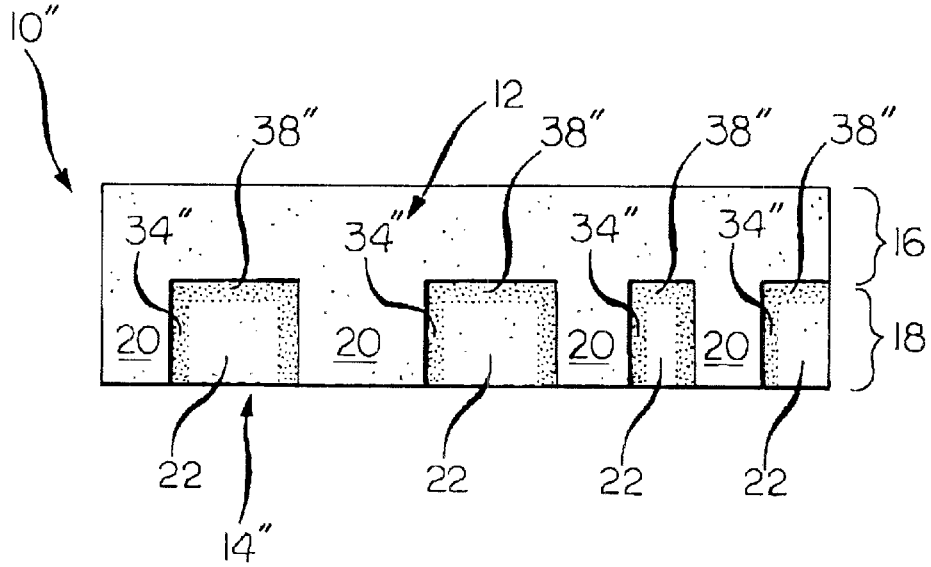
FIG. 7 is a top planar view of the completed shingle of FIG. 6.

FIGS. 6 and 7 illustrate a shingle 10" according to a third embodiment of the invention. In the third embodiment, the overlay member 12 is substantially identical to the overlay member 12 (FIG. 1) in the first embodiment. Similarly, the underlay member 14" is identical to the underlay member 14 of the first embodiment, except that both vertical edges 24, 26 of each tab 20 of the overlay member 12 expose a vertically-oriented shading area 34" to produce a "two-sided" shadow rendering design. In the third embodiment, it is desirable that a centerline 43 of the tab 20 is substantially parallel with the vertical axis, V', of the overlay member 12". Also, it is preferred that the centerline 43 of the tab 20 substantially aligns with the centerline V of the vertically-oriented shading area 34". As can be seen in FIG. 7, the completed shingle 10" of the third embodiment has a different shadow rendering design from the shingles 10, 10' of the earlier embodiments. It will be appreciated that any combination of the shadow rendering designs of the earlier embodiments of the invention can be applied to the shingle 10".

Figure 8:
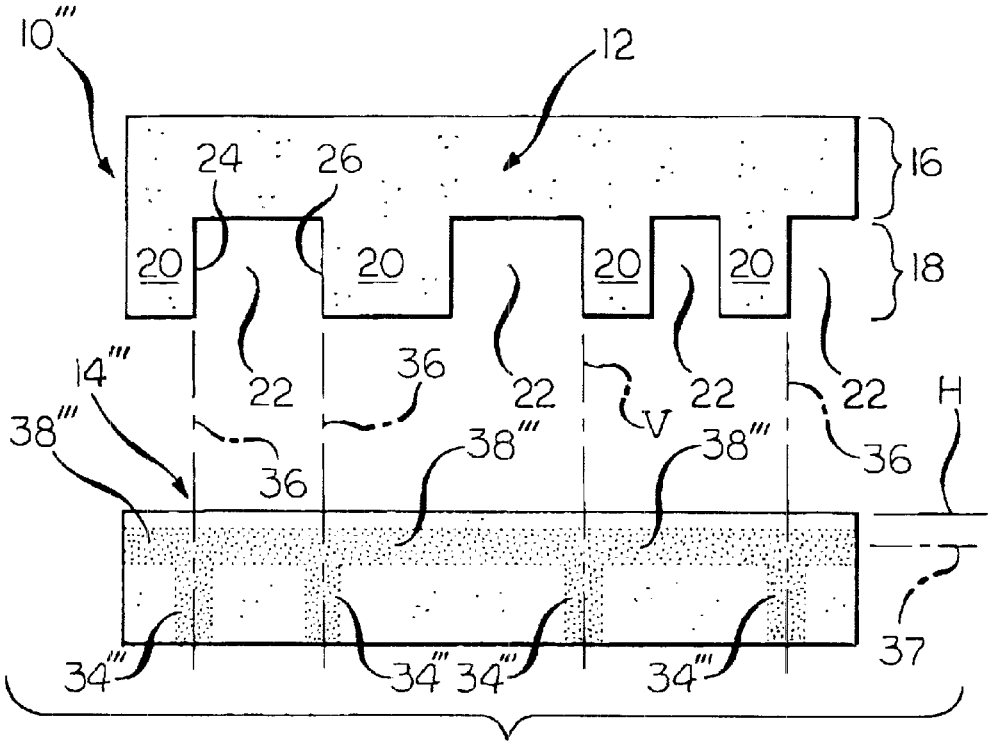
FIG. 8 is an exploded view of a shingle with a rendered shadow design according to a fourth embodiment of the invention.
Figure 9:
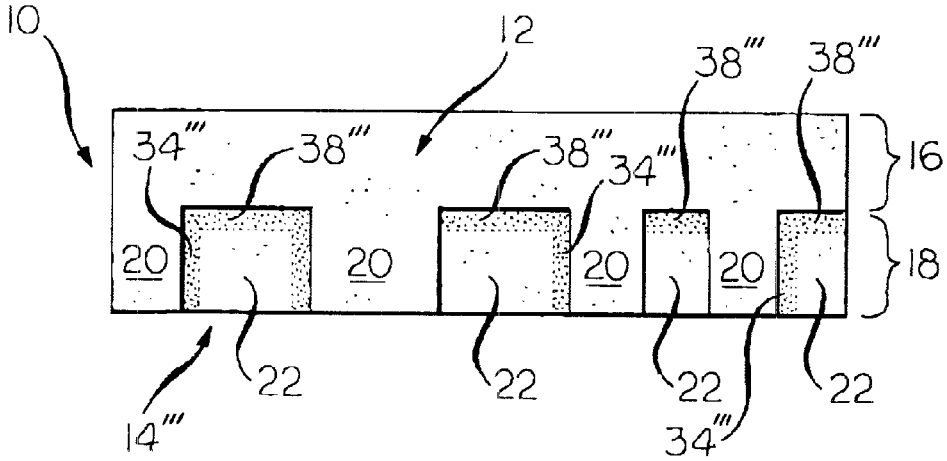
FIG. 9 is a top planar view of the completed shingle of FIG. 8.

FIGS. 8 and 9 illustrate a shingle 10''' according to a fourth embodiment of the invention. In the fourth embodiment, the overlay member 12 is substantially identical to the overlay member 12 (FIG. 1) in the first embodiment. The underlay member 14''' is identical to the underlay member 14 of the first embodiment, except that one or both of the vertical edges 24, 26 can be randomly aligned with the vertically-oriented longitudinal axis of the vertically-oriented shading area 34''' to produce a random pattern of the shadow rendering design. As best seen in FIG. 9, the completed shingle 10''' has a different rendering shadow design from the shingles 10, 10', 10" of the earlier embodiments of the invention. It will be appreciated that any combination of the shadow rendering designs of the earlier embodiments of the invention can be applied to the shingle 10'''.

Figure 10:
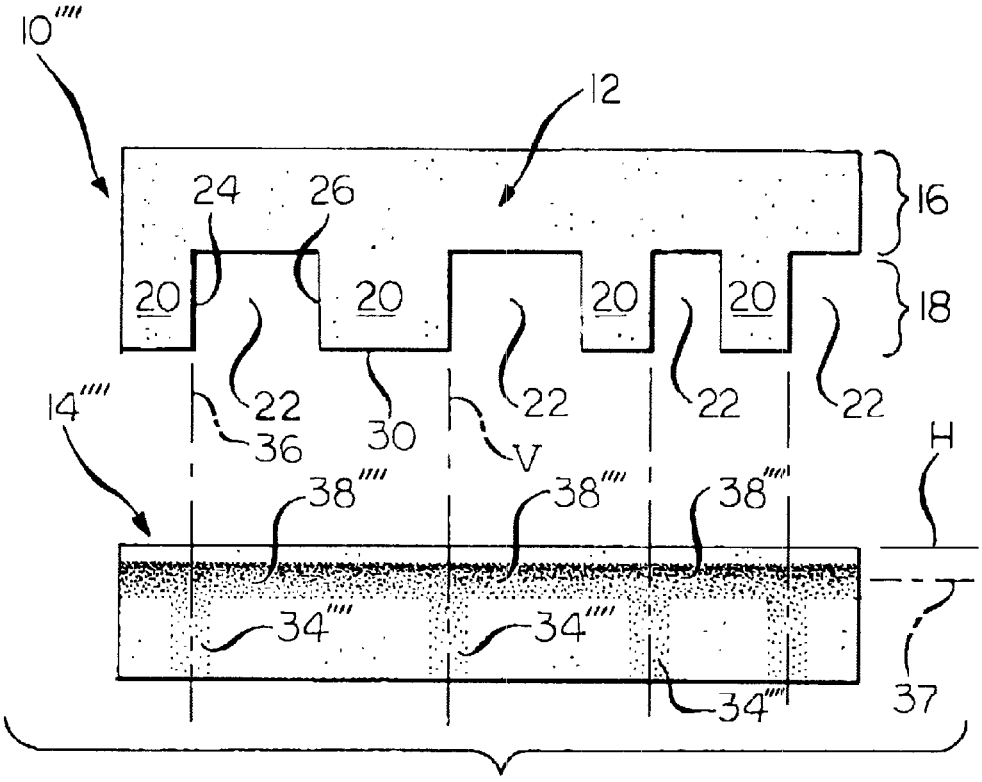
FIG. 10 is an exploded view of a shingle with a rendered shadow design according to a fifth embodiment of the invention.
Figure 11:
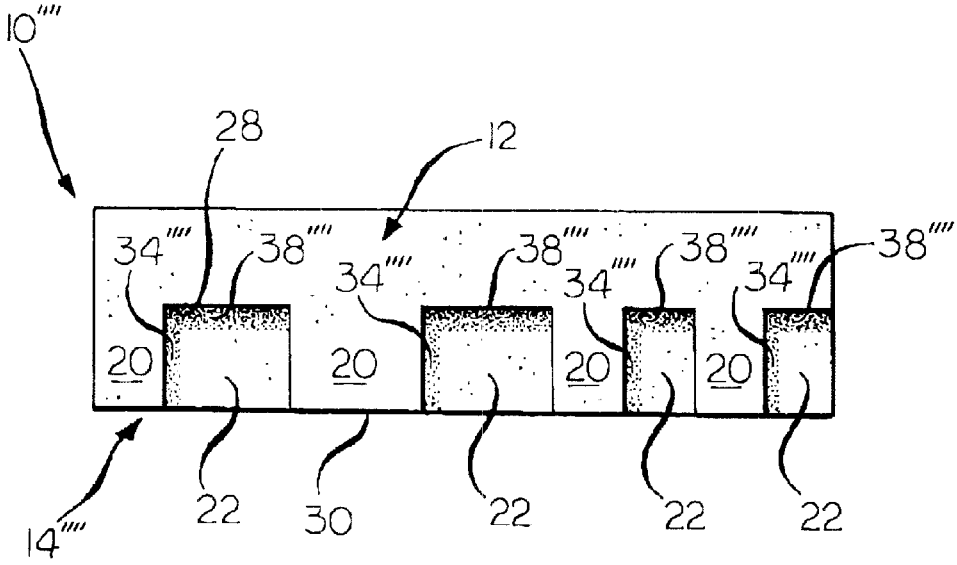
FIG. 11 is a top planar view of the completed shingle of FIG. 10.

FIGS. 10 and 11 illustrate a shingle 10"" according to a fifth embodiment of the invention. In the fifth embodiment, the overlay member 12 is substantially identical to the overlay member 12 (FIG. 1) in the first embodiment. The underlay member 14"" is identical to the underlay member 14 of the first embodiment, except that an intensity of the vertically-oriented shading area 34"" increases from the lower edge 30 of the overlay member 12 to the lower boundary 28 of the overlay member 12 (the upper edge of the cutout 22). As best seen in FIG. 11, the completed shingle 10"" has a different rendering shadow design from the shingles 10, 10', 10" and 10''' of the earlier embodiments of the invention. It will be appreciated that any combination of the shadow rendering designs of the earlier embodiments of the invention can be applied to the shingle 10"".

Figure 12:
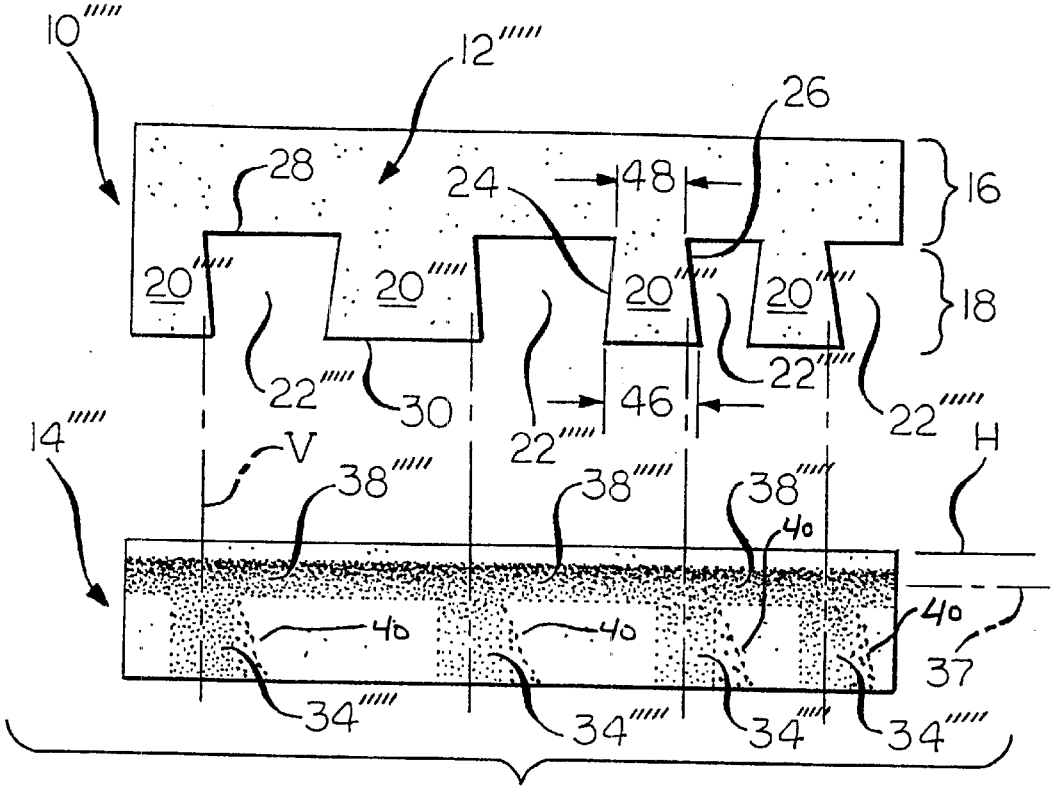
FIG. 12 is an exploded view of a shingle with a rendered shadow design according to a sixth embodiment of the invention.
Figure 13:
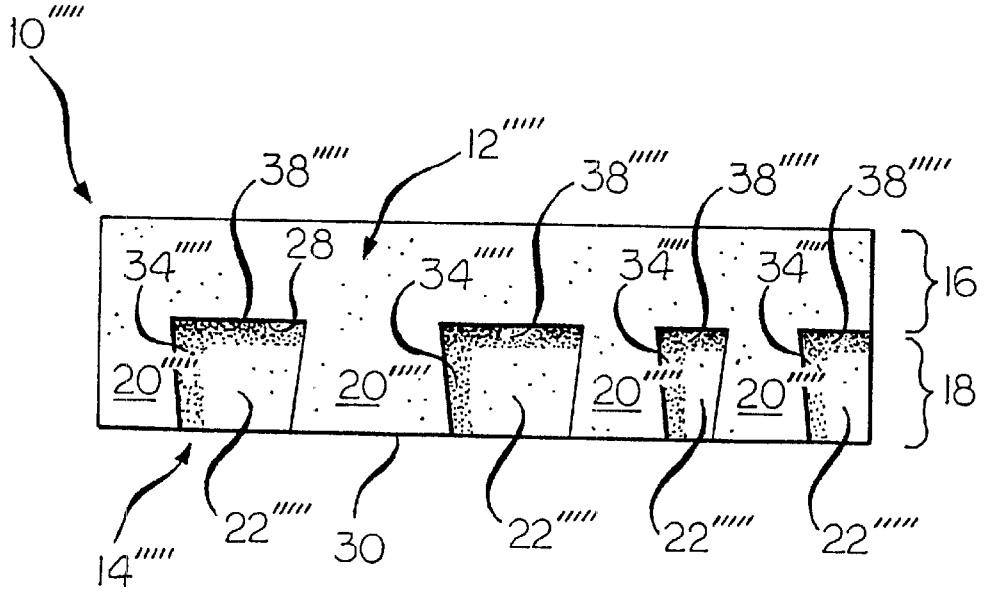
FIG. 13 is a top planar view of the completed shingle of FIG. 12.

FIGS. 12 and 13 illustrate a shingle 10""" according to a sixth embodiment of the invention. In the sixth embodiment, the overlay member 12""" is substantially identical to the overlay member 12 of the earlier embodiments, except that the width 46 of the lower edge of each tab 20""" is larger than the width 48 of the upper edge of each tab 20""" In other words, each tab 20""" tapers from the lower edge 30 along generally straight sides to its narrowest dimension at the upper edge 28 of the cutout 22""". As a result, the vertical edges 24, 26 of each tab 20""" are not generally parallel to the vertical axis, V, of the underlay member 14""", unlike the earlier embodiments of the invention. Oppositely, the width of each cutout 22""" at the upper edge 28 is larger than the width at the lower edge 30.

The underlay member 14""" is identical to the underlay member 14 of the first embodiment, except that the edge 40 of the vertically-oriented shading area 34""" is not substantially parallel to the vertical axis, V, of the underlay member 14""". In a manner similar to that of the earlier embodiments, the edges 40 of the vertically-oriented shading area 34""40 are generally parallel to the vertical edges 24, 26 of the overlay member 12""40 . As best seen in FIG. 13, the "dragontooth" design of the completed shingle 10""" has a different rendering shadow design from the shingles 10, 10', 10", 10''' and 10"" of the earlier embodiments of the invention. For illustrative purposes only, the intensity of the vertically-oriented shading area 34""" increases from the lower edge 30 to the lower boundary 28 of the overlay member 14""" (the upper edge of the cutout 22"""). However, it will be appreciated that any combination of the shadow rendering designs of the earlier embodiments of the invention can be applied to the shingle 10""".

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A laminated shingle, comprising:

an overlay member having a front surface, a rear surface, an upper portion and a lower portion, the lower portion including one or more tabs separated by cutouts, each cutout including a pair of spaced apart vertical edges extending from a lower boundary of the upper portion of the overlay member to a lower edge of the lower portion of the overlay member, each cutout also including an upper edge extending between the pair of vertical edges, and an underlay member having a front surface attached to the rear surface of the overlay member, the underlay member including a layer of granules on the front surface to form at least one vertically-oriented, generally elongated shading area having a vertically oriented longitudinal axis being substantially parallel to a vertical axis of the underlay member, the vertically-oriented shading area being darker in appearance than a remainder of the underlay member, wherein the vertically-oriented longitudinal axis of the at least one vertically-oriented shading area of the underlay member is generally collinear with at least one of the pair of edges of at least one cutout of the overlay member, thereby exposing, within a cutout, a portion of the vertically-oriented shading area of the underlay member.

2. The laminated shingle according to claim 1, wherein the underlay member further includes at least one horizontally-oriented shading area having a horizontally-oriented longitudinal axis being substantially parallel to a horizontal axis of the underlay member, and wherein the horizontally-oriented longitudinal axis of the at least one horizontally-oriented shading area of the underlay member substantially aligns with the upper edge of at least one cutout of the overlay member, thereby exposing a portion of the at least one horizontally-oriented shading area.

3. The laminated shingle according to claim 1, wherein an intensity of the at least one vertically-oriented shading area of the underlay member increases from the lower edge of the overlay member to the lower boundary of the upper portion of the overlay member.

4. The laminated shingle according to claim 1, wherein a width of the at least one vertically-oriented shading area is a function of a width of an adjacent tab.

5. A laminated shingle, comprising:

an overlay member having a front surface, a rear surface, an upper portion and a lower portion, the lower portion including one or more tabs separated by cutouts, each cutout including a pair of spaced apart vertical edges extending from a lower boundary of the upper portion of the overlay member to a lower edge of the lower portion of the overlay member, each cutout also including an upper edge extending between the pair of vertical edges, and an underlay member having a front surface attached to the rear surface of the overlay member, the underlay member including a layer of granules on the front surface to form at least one vertically-oriented shading area having two substantially vertical edges, being substantially parallel to a vertical axis of the underlay member, the shading area being darker in appearance than a remainder of the underlay member, wherein one of the cutout vertical edges is arranged so that it is positioned between the vertical edges of the shading area of the underlay member, thereby exposing a portion of the vertically-oriented shading area of the underlay member.

6. The laminated shingle according to claim 5, wherein the underlay member further includes at least one horizontally-oriented shading area having a horizontally-oriented longitudinal axis being substantially parallel to a horizontal axis of the underlay member, and wherein the horizontally-oriented longitudinal axis of the at least one horizontally-oriented shading area of the underlay member substantially aligns with the upper edge of at least one cutout of the overlay member, thereby exposing a portion of the at least one horizontally-oriented shading area.

7. A laminated shingle, comprising:

an overlay member having a front surface, a rear surface, an upper portion and a lower portion, the lower portion including tabs separated by cutouts, each tab having a centerline substantially parallel to a vertical axis of the overlay member, at least one tab being a relatively wide tab and at least one tab being a relatively narrow tab so that the tabs vary in width, and at least one cutout including a pair of vertical edges extending from a lower boundary of the upper portion of the overlay member to a lower edge of the overlay member and an upper edge extending between the pair of vertical edges, and an underlay member having a front surface attached to the rear surface of the overlay member, the underlay member including a layer of granules on the front surface to form vertically-oriented, generally elongated shading areas having vertically oriented longitudinal axes being substantially parallel to a vertical axis of the underlay member, wherein the centerline of each tab of the overlay member substantially aligns with a vertically-oriented longitudinal axis of the shading areas of the underlay member to expose a portion of each of the shading areas of the underlay member, and wherein the widths of the exposed portions of the vertically-oriented shading areas are a function of the widths of an adjacent tab.

8. The laminated shingle according to claim 7, wherein the underlay member further includes a horizontal shading area having a horizontally-oriented longitudinal axis being substantially parallel to a horizontal axis of the underlay member, and wherein the horizontally-oriented longitudinal axis of the horizontal shading area of the underlay member substantially aligns with the upper edge of the at least cutout of the overlay member, thereby exposing a portion of the horizontal shading area.

9. The laminated shingle according to claim 8, wherein an intensity of either the vertically-oriented shading areas, or the horizontal shading area, or both, increases from the lower edge of the overlay member to the lower boundary of the upper portion of the overlay member.

10. A laminated shingle, comprising:

an overlay member having a front surface, a rear surface, an upper portion and a lower portion, the lower portion including a series of tabs separated by cutouts, each cutout including a pair of spaced apart vertical edges extending from a lower boundary of the upper portion of the overlay member to a lower edge of the lower portion of the overlay member, each cutout also including an upper edge extending between the pair of vertical edges, and an underlay member having a front surface attached to the rear surface of the overlay member, the underlay member including a layer of granules on the front surface to form a series of vertically-oriented shading areas being darker in appearance than the remainder areas of the underlay member, each of the shading areas having a shading area edge separating the darker shading area from an adjacent, lighter remainder area of the shingle, wherein the shading area edges are arranged so that they are positioned between the vertical edges of the cutouts, thereby exposing portions of the shading areas of the underlay member.

11. The laminated shingle according to claim 10, wherein the underlay member further includes at least one horizontally-oriented shading area having a horizontally-oriented longitudinal axis being substantially parallel to a horizontal axis of the underlay member, and wherein the horizontally-oriented longitudinal axis of the at least one horizontally-oriented shading area of the underlay member substantially aligns with the upper edge of at least one cutout of the overlay member, thereby exposing a portion of the at least one horizontally-oriented shading area.

12. The laminated shingle according to claim 10, wherein an intensity of the at least one vertically-oriented shading area of the underlay member increases from the lower edge of the overlay member to the lower boundary of the upper portion of the overlay member.

13. A roof covering including a plurality of successive generally horizontal courses of laminated shingles, the shingles in each course being laid in a side-by-side relationship and horizontally offset from the shingles in adjacent courses, each laminated shingle comprising:

an overlay member having a front surface, a rear surface, an upper portion and a lower portion, the lower portion including one or more tabs separated by cutouts, each cutout including a pair of spaced apart vertical edges extending from a lower boundary of the upper portion of the overlay member to a lower edge of the lower portion of the overlay member, each cutout also including an upper edge extending between the pair of vertical edges, and an underlay member having a front surface attached to the rear surface of the overlay member, the underlay member including a layer of granules on the front surface to form at least one vertically-oriented shading area having two substantially vertical edges, being substantially parallel to a vertical axis of the underlay member, the shading area being darker in appearance than a remainder of the underlay member, wherein one of the cutout vertical edges is arranged so that it is positioned between the vertical edges of the shading area of the underlay member, thereby exposing a portion of the vertically-oriented shading area of the underlay member.

14. The roof covering according to claim 13, wherein the underlay member further includes at least one horizontally-oriented shading area having a horizontally-oriented longitudinal axis being substantially parallel to a horizontal axis of the underlay member, and wherein the horizontally-oriented longitudinal axis of the at least one horizontally-oriented shading area of the underlay member substantially aligns with the upper edge of at least one cutout of the overlay member, thereby exposing a portion of the at least one horizontally-oriented shading area.

15. The roof covering according to claim 13, wherein an intensity of the at least one shading area of the underlay member increases from the lower edge of the overlay member to the lower boundary of the upper portion of the overlay member.

16. The roof covering according to claim 13, wherein a width of the at least one shading area is a function of a width of an adjacent tab.

17. A roof covering including a plurality of successive generally horizontal courses of laminated shingles, the shingles in each course being laid in a side-by-side relationship and horizontally offset from the shingles in adjacent courses, each laminated shingle comprising:

an overlay member having a front surface, a rear surface, an upper portion and a lower portion, the lower portion including one or more tabs separated by cutouts, each cutout including a pair of spaced apart vertical edges extending from a lower boundary of the upper portion of the overlay member to a lower edge of the lower portion of the overlay member, each cutout also including an upper edge extending between the pair of vertical edges, and an underlay member having a front surface attached to the rear surface of the overlay member, the underlay member including a layer of granules on the front surface to form at least one vertically-oriented, generally elongated shading area having a vertically-oriented longitudinal axis being substantially parallel to a vertical axis of the underlay member, the vertically-oriented shading area being darker in appearance than a remainder of the underlay member, wherein the vertically-oriented longitudinal axis of the at least one vertically-oriented shading area of the underlay member is generally collinear with at least one of the pair of edges of at least one cutout of the overlay member, thereby exposing, within a cutout, a portion of the vertically-oriented shading area of the underlay member.

18. The roof covering according to claim 17, wherein the underlay member further includes at least one horizontally-oriented shading area having a horizontally-oriented longitudinal axis being substantially parallel to a horizontal axis of the underlay member, and wherein the horizontally-oriented longitudinal axis of the at least one horizontally-oriented shading area of the underlay member substantially aligns with the upper edge of at least one cutout of the overlay member, thereby exposing a portion of the at least one horizontally-oriented shading area.

19. The roof covering according to claim 17, wherein an intensity of the at least one vertically-oriented shading area of the underlay member increases from the lower edge of the overlay member to the lower boundary of the upper portion of the overlay member.

20. The roof covering according to claim 17, wherein a width of the at least one vertically-oriented shading area is a function of a width of an adjacent tab.

* * * * *